US005273502A

United States Patent [19]

Kelsey et al.

[11] Patent Number: 5,273,502

[45] Date of Patent: Dec. 28, 1993

[54] THERAPEUTIC UNLOADING APPARATUS AND METHOD

[75] Inventors: Douglas Kelsey; Alan Walls, both of Austin, Tex.

[73] Assignee: Soma, Inc., Austin, Tex.

[21] Appl. No.: 58,668

[22] Filed: May 10, 1993

Related U.S. Application Data

[63] Continuation of Ser. No. 717,676, Jun. 19, 1991.

[51] Int. Cl.[5] ..... A63B 23/04

[52] U.S. Cl. ..... 482/69; 482/66; 128/25 R

[58] Field of Search ..... 482/66-69; 128/28 R; 5/89.1, 600-624

[56] References Cited

U.S. PATENT DOCUMENTS

| | | | |
|---|---|---|---|
| 3,761,082 | 9/1973 | Barthel, Jr. | 482/69 |
| 4,410,175 | 10/1983 | Shamp | 482/69 |
| 4,973,044 | 11/1990 | Jones | 482/67 |

FOREIGN PATENT DOCUMENTS

| | | | |
|---|---|---|---|
| 2252108 | 6/1975 | France | 482/69 |

*Primary Examiner*—Randall L. Green
*Assistant Examiner*—Rob Clarke
*Attorney, Agent, or Firm*—Shaffer & Culbertson

[57] ABSTRACT

A therapeutic unloading apparatus and method for exercising specific amounts of body weight in an upright position without overloading healing tissue. A support frame is provided to which is attached an automatic winch. The winch is attached to a spring, the spring is attached to a harness cable and thence to a harness. A user is tightly secured within the harness and a load cell is utilized to determine how much weight to unload from the patient/user. After the predetermined amount of weight has been unloaded it is set. Because the load cell is connected to the winch, a constant unloaded value is maintained throughout the range of normal to aggressive exercising for the injured patient. The normal exercising motions of a quick to fast walk, to run, to jog results in multiple vertical oscillations. By means of the spring dampener and the automatic outlay and intake of cable by means of the winch, a constant load is maintained on the user and hence the injury. A simple frame is used to support the user from above and enables the utilization of a treadmill so that running in a straight line is permitted.

13 Claims, 3 Drawing Sheets

THERAPEUTIC UNLOADING APPARATUS AND METHOD

This application is a continuation of application Ser. No. 07/717,676 filed Jun. 19, 1991.

BACKGROUND OF THE INVENTION

This invention relates to an improved therapeutic unloading apparatus and method.

Both manual and automatically driven therapeutic devices have been known in the art for quite some time. For example, physical therapists have for years treated patients with lower extremity problems in sitting positions. Whether the therapy is manual or mechanical, there is mounting evidence that rehabilitating individuals in this sitting position is less than optimal because the training does not carry over well into an upright position. Because humans function largely on their feet, the inadequacy of prior art therapy in the sitting position is a serious problem. The problem with prior art non-upright therapy lies in the forces that are generated in the upright position on an individual with a lower extremity or back injury. This is precisely why therapy in the lying or sitting position has been used in the past.

Some therapeutic devices attempt to enable therapy while in an upright position. An example of an upright therapeutic device is disclosed in Jones U.S. Pat. No. 4,973,044 which can provide a lifting force on patients while they are either walking or performing motor activities that involve relatively low speed, low frequency vertical motions (i.e. sitting down or getting out of bed). A complicated, space-gobbling device, it also forces the user to follow a circular path. The circular path of this and other devices may be suitable for a slow walk, but is detrimental to a patient's recovery when running because it altars the normal stride substantially.

Another example of a lifting device for patients is Futakami U.S. Pat. No. 4,907,571. Once again, it is designed to be utilized with a patient that is walking or performing motor activities that involve relatively low speed, low frequency vertical motions.

A drawback to the lifting devices known in the art is that if the devices described in the prior art are subjected to rapid or oscillating vertical motions, such as a patient would generate while walking at speeds of 4 to 5 mph, running, jumping, or squatting, the response time of the known pneumatic air cylinders, pulleys and counterweights, or hydraulic cylinders is insufficient to maintain a uniform lifting force on the patient. Simply put, the mechanical natural frequency of the prior art systems is too low and results in significant oscillations in lifting force, if the device is used at other than relatively low speeds, which tend toward being out-of-phase with the vertical oscillation of the patient as the frequency of the vertical oscillation is increased. This results in a very uncomfortable and possibly harmful jerking of the patient during activities where higher frequency vertical motions are required, again, such as fast walking, running or jumping. Thus, there is need in the art for providing a therapeutic unloading apparatus and method which allows much higher system natural frequencies, produced while doing anything other than a slow walk, and which provides a uniform lifting force over a wide range of vertical travel and through higher oscillatory frequencies of that vertical travel. It, therefore, is an object of this invention to provide an improved therapeutic unloading apparatus and method for automatically maintaining a set load while the load varies, back and forth, from more than to less than the set load.

SUMMARY OF THE INVENTION

Accordingly, the therapeutic unloading apparatus and method of the present invention includes a frame to which a winch is mounted. A spring is attached at one end to the winch and at the other end to a support harness. A load cell is connected to the winch so that the winch automatically maintains a set load while the load varies back and forth from more than to less than the set load. Cables interconnect the winch, spring and harness in a preferred embodiment.

Further, the support frame is preferably comprised of a pair of oppositely positioned strength beams. These beams are interconnected by means of a transverse support within which is an opening from which the harness cable descends so that when a user wears the harness the user is supported from the transverse support from above.

The winch includes a motor driven clutch, such as a magnetic particle clutch, can be coupled with the load cell so that a uniform lifting force is maintained despite high speed, wide range, oscillating vertical motions produced by a user in a harness when the user participates in activities any more strenuous than slow walking.

The load cell has a remotely operable activator, on off switch, so that a therapist can "unload" a user while observing the user at close hand. Further, a remote "unloading" readout is provided at the remotely operable activator that provides the therapist with information concerning the precise amount of weight that is unloaded from a user.

The support harness includes a waist encircling abdominal strap that "grasps" the user very snugly so that there is no shifting of the abdominal strap as strain is taken on the support cable, i.e. as the user is "unloaded." A pair of arm loops are attached at opposite sides to the waist encircling abdominal strap and from those arm loops a corresponding pair of harness cable connectors are attached. These two connectors are attached to a single harness bar at the bar's opposite ends. The center of the bar is connected to the harness cable at the midpoint of the bar so that as the user is "unloaded," weight is lifted evenly on both sides of the user through the encircling abdominal strap. As a result, the user is lifted precisely, evenly, and accurately.

Because of the compact nature of the device and the simplicity of it, it utilizes very little room in a therapeutic setting. Further, because the user is suspended from the center of the support frame a simple treadmill may be placed underneath the user between the strength members. This enables the user to safely exercise quick to fast walking, to running, jogging, and jumping while placing uniform stress on both legs. That is, because the treadmill results in a straight ahead movement, and not the circular movement known in prior art devices, the unnatural forces on one side or the other of the body caused by circular running are eliminated.

Other objects, advantages, and features of the present invention will become more fully apparent from the following detailed description of the preferred embodiments, the appended claims, and the accompanying drawings.

DESCRIPTION OF THE PREFERRED EMBODIMENTS

Figure 1:
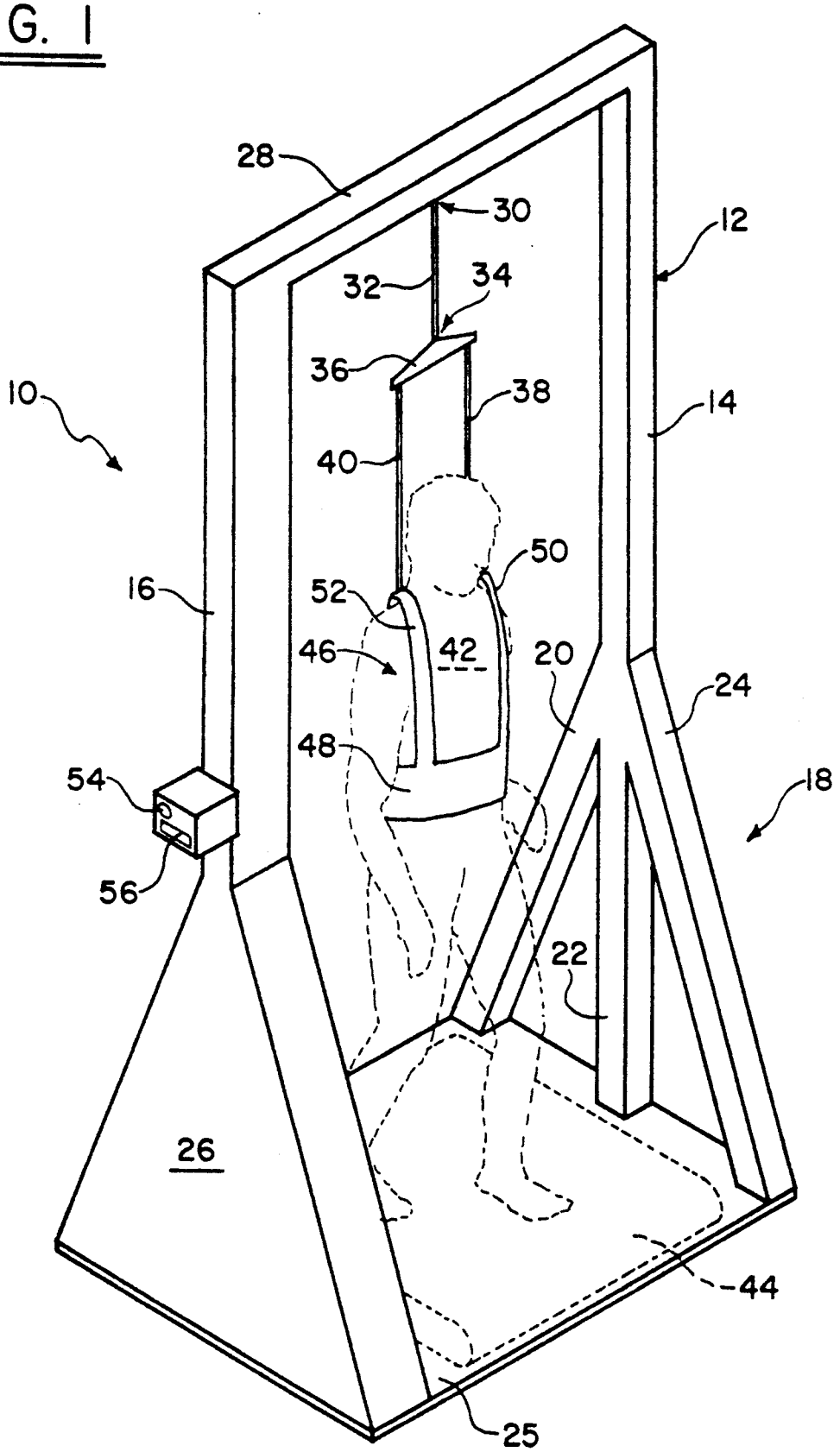
FIG. 1 is a plan view of a preferred embodiment of the therapeutic unloading mechanism of the present invention with a user in the harness. The user is shown in dashed lines as is a treadmill device.
Figure 2:
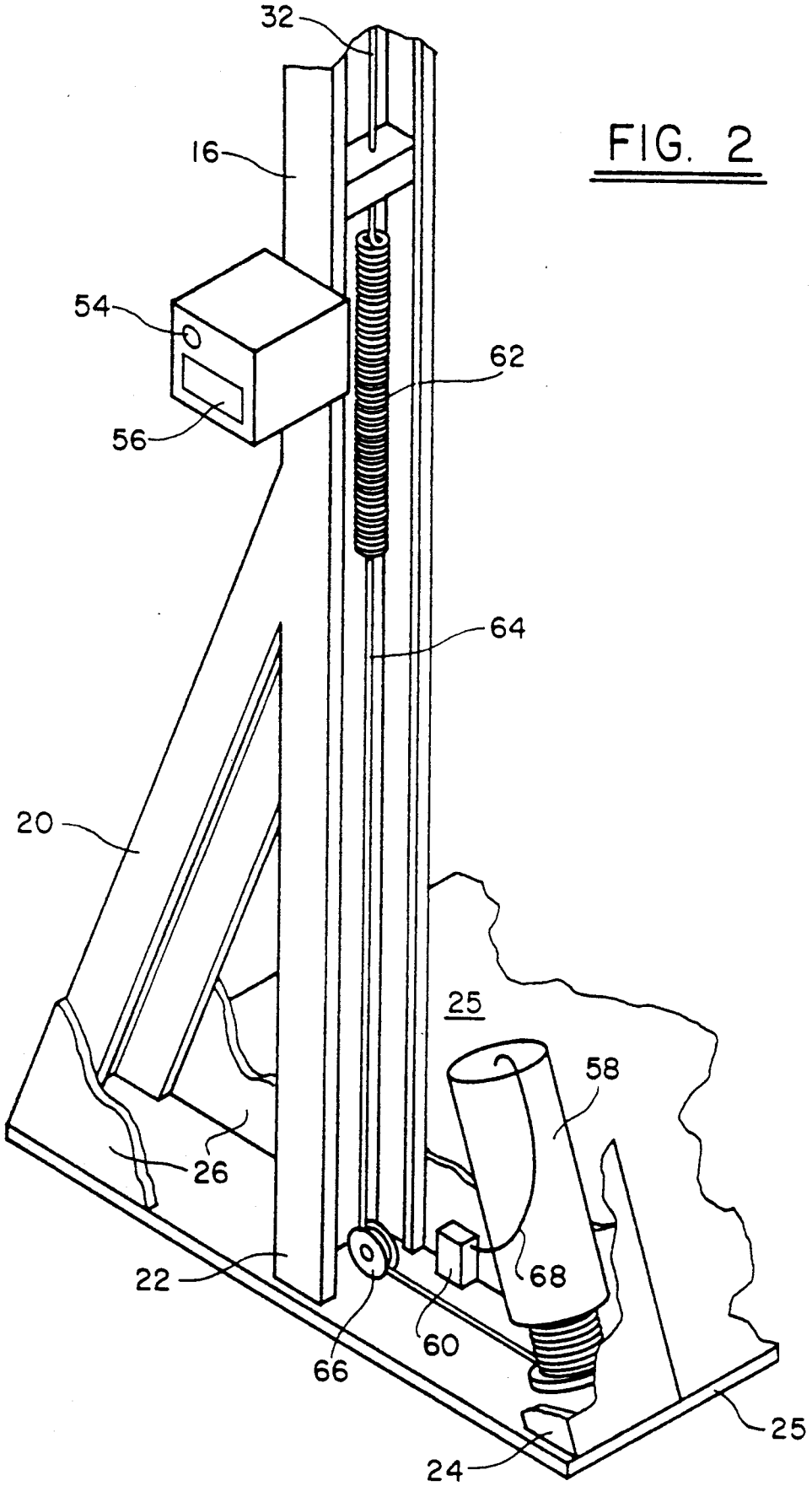
FIG. 2 is a partial cut-away view showing the internal location of the winch, load cell, spring and cable connections.
Figure 3:
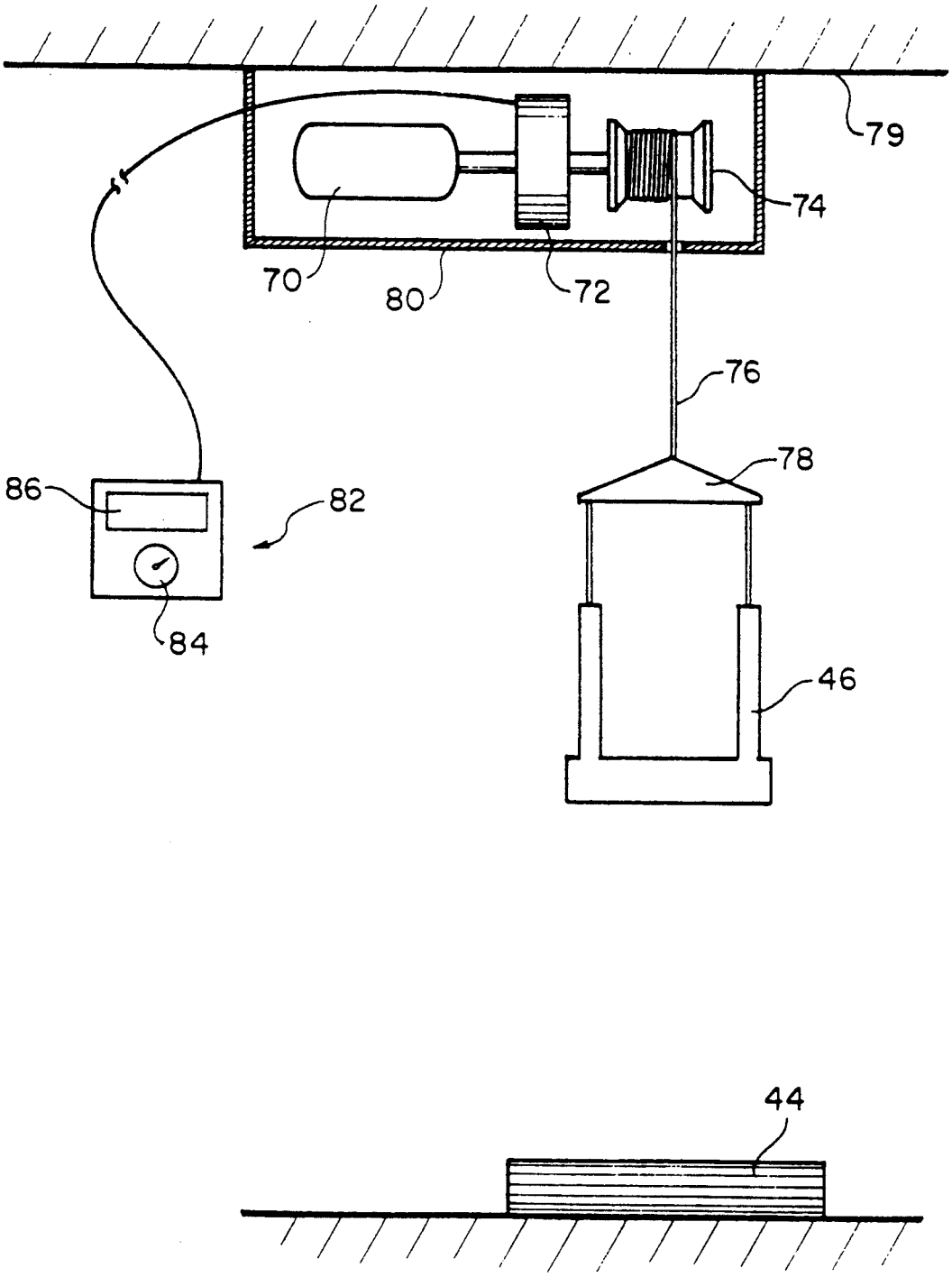
FIG. 3 is a plan view of another preferred embodiment of the therapeutic unloading mechanism of the present invention shown suspended from a ceiling.

The preferred embodiment of the present invention is illustrated by way of example in FIGS. 1-3. With specific reference to FIG. 1, a therapeutic unloader 10 includes a frame 12 with a pair of oppositely positioned strength members 14 and 16. Strength members 14 and 16 are supported on a wide base 18, to prevent wobbling. This base 18 is comprised of three leg members 20, 22, and 24 for each strength member 14 and 16. Leg members 20, 22, and 24 are attached to base plate 25. Base 18 is covered by rigidity section 26 on the outside of base 18. Rigidity section 26 also conceals the interior operation of the device and presents a smooth appearance.

Strength members 14 and 16 are interconnected at the top of frame 12 by means of an overhead transverse support 28. Overhead transverse support 28 has an opening 30 (not shown) through which harness cable 32 protrudes. Harness cable 32 is connected at point 34 to harness bar 36. A pair of harness cable connectors 38 and 40 are connected to the opposite ends of harness bar 36. That is, point 34 is located at the midpoint of harness bar 36 between harness cable connectors 38 where they attach to harness bar 36.

FIG. 1 shows patient/user 42 in dashed lines. Patient 42 is shown standing on treadmill 44, also in dashed lines. Patient 42 is secured within harness 46. Harness 46 is comprised of a waist encircling abdominal strap 48 that is designed to very snugly encircle user 42. The harness 46 must snugly fit user 42 so that when cable 32 is lifted and the patient is "unloaded" harness 46 must not rise or shift at all. A pair of arm loops 50 and 52 are attached at opposite sides of waist encircling abdominal strap 48.

Finally, FIG. 1 illustrates remotely operable activator 54 and remote unloading readout 56.

Referring now to FIG. 2, the inner workings and hidden mechanisms of therapeutic unloader 10 are disclosed. As shown, base 18, with rigidity section 26 partially cut away, contains winch 58, load cell 60 and spring 62. Winch 58 is connected to spring 62 by means of winch cable 64. Winch cable 64 passes around cable guide 66 before being attached to one end of spring 62.

The actual unloading force provided to the patient 42 is measured by the load cell 60. The desired unloading force is input into control circuitry associated with the load cell 60. Initially, a change in rotational position of the winch 58 unloads the patient 42 a selected amount. However, once the patient 42 begins exercise, if the winch 58 remains in the same rotational position, the unloading force changes. Therefore, to provide a constant unloading force, the control circuitry monitors the unloading force via the load cell 58 and causes the winch 60 to change its rotational position in response to a change in position of the patient 42, thereby causing the unloading force to be substantially constant. Because the winch 58 is fast acting, it reacts quickly to patient 42 movement and provides a nearly constant unloading force.

Further, the spring 62 assists in providing a constant unloading force. The spring 62 has a low spring constant so that small variations in the length of the spring result in little change in the force applied by the spring. Therefore, the spring assists the winch 58, load cell 60, and the associated control circuitry in providing a constant unloading force to the patient 42 by absorbing small positional variations without changing significantly the applied force.

In operation, therapeutic unloader 10 functions as follows. First, however, a clear understanding of the term "unloading" is important. Once again, the field of the invention is the upright therapeutic rehabilitation of a patient/user without further injuring the patient. Upright therapy of the patient 42 is accomplished by means of invention 10 by "unloading" a portion of the user's full body weight from the weight bearing portions of the person, i.e. trunk, knees, ankles, feet, etc. For example, a person weighing 150 pounds with a recently operated knee might only be able to handle a standing body weight on that knee of 50 pounds initially. By means of invention 10, of the total 150 pound body weight 100 pounds is "unloaded" so that the remaining weight on the knee equals 50 pounds, no more and no less. That is, throughout the course of the exercise, the invention 10 automatically adjusts for the vertical oscillations of the patient through normal movement, i.e. running, jumping, etc., so that the 50 pounds, once set, is maintained throughout the exercise. As the oscillation increases, the amount of unloading increases as well to fully protect the healing tissue.

Returning now to the operation of invention 10, user 42 is placed in harness 46. Harness 46 has a waist encircling abdominal strap 48 that is wrapped snugly around the abdomen and, in some cases, lower chest of the user 42. The waist encircling strap is connected by means of hooks and loops, snaps, buckles, or any known and convenient method in the art. The important point is that waist encircling abdominal strap must be tight enough to prohibit movement of the strap once secured. This movement must be prohibited upward and downward. User 42 then is connected through arm loops 50 and 52, harness cable connectors 38 and 40, and harness bar 36 to harness cable 32. By means of the placement of the attachment to harness bar 36, any weight that is unloaded from user 42 by harness cable 32 is removed evenly and equally from user 42 on both sides of user 42 so that no unequal lifting or tilting is introduced.

Once user 42 is safely within harness 46, the therapist utilizes remotely operable activator 54 which energizes winch 58 which is connected to load cell 60. At that point the amount of weight which is "unloaded" from user 42 is displayed on remote unloading readout 56. At the point where the desired amount of unloaded weight is reached, the load is set. Having set the load, invention 10, through load cell 60, electrical connection 68 and winch 58, automatically adjusts the load throughout the therapy session according to the extent of the vertical oscillation. Importantly, invention 10 enables actual therapy of the injured portion of patient 42 at above slow walk speeds. That is, as the patient/user 42 improves from the first few days when only very slow walking may be accomplished to fast walking, running, and jogging, a constant load relative to the excursion vertically of the human body will be maintained through activator 54, as previously discussed. As the user 42 moves from quick to fast walking to running to jogging, more and more vertical oscillations are introduced to cable 32. Be means of spring 62, load cell 60 and winch 58 the oscillations are absorbed, partially by spring 62 and partially by winch 58 which lets out and takes in cable as significant vertical oscillations occur. As a result, the uncomfortable and possibly harmful jerking to patient 42, known in the prior art, is eliminated.

Also importantly, invention 10 allows the utilization of standard treadmills 44. The treadmill is a piece of therapeutic equipment present in almost every therapist's office. Invention 10 can be easily moved so that base 18 and associated leg members straddle treadmill 44 As a result, invention 10 enables running and walking in a straight path. A straight path does not artificially induce unnatural stress in unequal amounts to various parts of user's 42 body. Instead, the straight line path equally exercises user 42 by enabling him to use a normal straight ahead stride.

Invention 10 is virtually maintenance free in that it contains no hydraulics or pumps. Further, its simple design and low space requirements add up to a cost effective and efficient device.

Referring now to FIG. 3, another preferred embodiment of the invention is disclosed. This embodiment is comprised of motor 70 which drives a magnetic clutch, of a type known in the art and not disclosed further hereafter, 72. Connected to the magnetic clutch 72 is a cable spool 74. Cable 76 is attached at one end to cable spool 74 and at the other end to a hanger 78. Harness 46 is suspended from hanger 78 as previously disclosed in FIGS. 1 and 2. Motor 70, magnetic clutch 72, and cable spool 74 are attached to ceiling 79, in this embodiment, and enclosed by enclosure 80. Clutch controller 82 controls motor driven magnetic clutch 72 and includes an unloading force adjustment dial 84 as well as unloading readout 86. This embodiment, which replaces winch 58 with magnetic clutch 72, enables the utilization of the unloading principles previously set forth while allowing the elimination of spring 62 and load cell 60, if desired. Further, the use of magnetic clutch 72 with feedback controls 84 and 86 provide the automatic control of the unloading force without need of load cell 60. Still further, in this embodiment, support frame 12 can be eliminated and the invention can be mounted to the ceiling 78 directly above treadmill 44, or other therapeutic devices. In this embodiment then, the cable 76, harness 46 and hanger 78 are all that hang down from ceiling 79. As a result, clinic floor space savings are realized.

While the therapeutic unloading apparatus and method of the present invention has been disclosed in connection with physical therapy and treatment of injuries, it should be appreciated that the unloading principle of the invention can be used in other methods and devices. That is, a principle feature of invention 10 is that as an individual moves into positions in which gravity has an increasing effect, invention 10 increases the amount of unloading accordingly. Thus, the present invention can be utilized with acrobatic instructions, athletic maneuvers, and a wide variety of other areas where weight needs to be lifted off the individual while the individual continues to exercise and/or move in a certain manner.

While the present invention has been disclosed in connection with the preferred embodiment thereof, it should be understood that there may be other embodiments which fall within the spirit and scope of the invention as defined by the following claims.

What is claimed:

1. A controlled loading body of weight bearing exercise apparatus comprising:

(a) a frame;

(b) an electrically driven winch means mounted on said frame;

(c) a spring means attached at one end of said winch means and at the other end to a support harness means;

(d) a load cell means connected to said winch means for detecting a force exerted by said winch means on said spring means; and (e) a winch control means operating in conjunction with said load cell means for precisely and automatically causing said winch means to exert a constant force on said spring means thereby causing said winch means to compensate for relative motion between the support harness means and the frame during use.

2. A therapeutic unloading apparatus for exercising specific amounts of body weight in an upright position without overloading healing tissue comprising:

(a) a support frame;

(b) an electrically driven winch means mounted on said frame;

(c) a winch cable attached at a first end to said winch means;

(d) a spring means attached at a first end to a second end of said winch cable;

(e) a harness cable attached at a first end to a second end of said spring means;

(f) a harness means attached to a second end of said harness cable;

(g) a load cell means connected to said winch means for detecting a force exerted by said winch means on said winch cable; and (h) a winch control means operating in conjunction with said load cell means for precisely and automatically causing said winch means to exert a constant force on said winch cable thereby causing said winch control means to compensate for relative motion between said harness means and said support frame during use.

3. The apparatus of claim 2 wherein said support frame further comprises:

(a) a pair of oppositely positioned strength members;

(b) an overhead transverse support means interconnecting said strength members; and (c) an opening in said transverse support means from which said second end of said harness cable protrudes so that when a user wears said harness means said user is supported from above.

4. The apparatus of claim 3 wherein said winch means further comprises a motor driven clutch means coupled with said load cell means so that a uniform lifting force is maintained despite high speed, wide range, oscillating vertical motions.

5. The apparatus of claim 4 wherein said load cell means further comprises:

(a) a remotely operable activating means so that a therapist can unload said user while observing said user; and (b) a remote unloading readout so that a precise amount of weight can be unloaded from said user when using said remotely operable activating means.

6. The apparatus of claim 5 wherein said harness means further comprises:

(a) a waist encircling abdominal strap means;

(b) a pair of arm loops attached at opposite sides of said waist encircling abdominal strap means;

(c) a corresponding pair of harness cable connecting means attached at a first end to said arm loops and at a second end to a harness bar; and (d) said harness bar connected to said harness cable at a point midway between said harness connecting means so that as said user is unloaded, weight is lifted evenly on both sides of said user.

7. A therapeutic unloading method for exercising specific amounts of body weight in an upright position without overloading healing tissue comprising the steps of:

(a) constructing a support frame;

(b) mounting an electrically driven winch means on said support frame;

(c) attaching a spring means at one end to said winch means and at the other end to a support harness means;

(d) connecting a load cell means to said winch means for detecting a force exerted by said winch means on said spring means;

(e) providing a winch control means that operates in conjunction with said load cell means, the winch control means for precisely and automatically causing said winch means to exert a constant force on said spring means thereby causing said winch means to compensate for relative motion between the support harness means and the support frame during use;

(f) placing a treadmill underneath said frame and beneath a user;

(g) placing said user in said harness means and unloading a precise amount of weight from said user; and (h) exercising said user on said treadmill through rapid oscillating vertical motions such as running, jumping, and squatting while maintaining a constant set load.

8. The method of claim 7 wherein constructing said support frame further comprises the steps of:

(a) constructing a pair of oppositely positioned strength members;

(b) interconnecting said strength members by an overhead transverse support means; and (c) providing an opening in said transverse support means from which said support harness means protrudes so that when a user wears said harness means said user is supported from above.

9. The method of claim 8 wherein mounting said winch means further comprises the step of coupling a motor driven clutch means with said load cell means so that a uniform lifting force is maintained despite high speed, wide range, oscillating vertical motion.

10. The method of claim 9 wherein connecting said load cell means further comprises the steps of:

(a) providing a remotely operable activating means so that therapist can unload said user while observing said user; and (b) providing a remote unloading readout so that a precise amount of weight can be unloaded from said user when using said remotely operable activating means.

11. The method of claim 10 wherein attaching said support harness means further comprises the steps of:

(a) providing a waist encircling abdominal strap means;

(b) attaching a pair of arm loops at opposite sides of said waist encircling abdominal strap means;

(c) attaching a corresponding pair of harness cable connecting means at a first end to said arm loops and at a second end to a harness bar; and (d) connecting said harness bar to said harness support means at a point midway between said harness cable connecting means so that as said user is unloaded, weight is lifted evenly on both sides of said user.

12. A therapeutic unloading apparatus comprising:

(a) an electric motor-driven clutch means;

(b) a cable spool means connected to said clutch means;

(c) a cable attached to one end to said cable spool means and at the other end to a hanger;

(d) a harness attached to said hanger;

(e) a load cell means connected to said motor-driven clutch means for detecting a force exerted by said motor-driven clutch means on said cable spool means; and (f) a clutch control means operating in conjunction with said load cell means for precisely and automatically causing said motor-driven clutch means to exert a constant force on said cable spool means, said clutch control means causing said motor-driven clutch means to compensate for relative motion between the harness and said cable spool means during use.

13. The apparatus of claim 12 further comprising:

(a) an overhead mounting means so that said motor-driven clutch means and said cable spool means are secured directly above a user; and (b) an unloading readout on said clutch means controller.

* * * * *